United States Patent [19]

Seilly

[11] 4,334,205

[45] Jun. 8, 1982

[54] ELECTROMAGNETIC DEVICES

[75] Inventor: Alec H. Seilly, North Wembley, England

[73] Assignee: Lucas Industries Limited, Birmingham, England

[21] Appl. No.: 247,333

[22] Filed: Mar. 25, 1981

[30] Foreign Application Priority Data

May 2, 1980 [GB] United Kingdom ..... 8014737

[51] Int. Cl.[3] ..... H01F 7/08

[52] U.S. Cl. ..... 335/220; 310/27

[58] Field of Search ..... 335/251, 255, 256, 261, 335/266, 268, 279, 281, 220; 310/27

[56] References Cited

U.S. PATENT DOCUMENTS 3,353,040 11/1967 Abbott ..... 310/27

4,003,013 1/1977 Seilly ..... 335/220

4,090,097 5/1978 Seilly ..... 310/27

*Primary Examiner*—George Harris

[57] ABSTRACT

An electromagnetic device comprises an annular armature an inner stator structure defining outwardly extending pole pieces and an outer stator structure defining inwardly extending pole pieces, the armature being of generally tapering form. The stator structures each carry windings whereby when the winding on the outer stator structure is energized the armature will move in one direction and when the winding on the inner stator structure is energized the armature will move in the other direction. The stator structures are so disposed that the magnetic circuits in the armature for the flux produced by the inner and outer stator structures when the respective windings are energized, are displaced relative to each other.

5 Claims, 4 Drawing Figures

ELECTROMAGNETIC DEVICES

This invention relates to an electromagnetic device of the kind comprising an elongated inner stator structure which defines a plurality of axially spaced annular magnetisable pole pieces, said pole pieces having diameters which increase towards one end of the stator structure, a winding carried by the stator structure and which when supplied with electric current causes adjacent pole pieces to assume opposite magnetic polarity, and an annular armature surrounding the stator structure said armature being formed from magnetisable material and having a generally tapered inner surface whereby when current is supplied to the winding the armature will move axially towards the one end of the stator structure.

With the form of device mentioned above the armature has to be returned to its initial position by the action of an external force such for example as that provided by a spring which may be incorporated in the construction of the device which may form part of the mechanism for example a valve operated by the device. In some cases however, it may be desirable for the mechanism to be driven back to its initial position. This could be achieved by providing another device of the kind described working in opposition, the two devices being mounted generally in end to end relationship. This solution is however bulky and expensive and furthermore increases the mass of the moving parts so that a reduced operating speed is obtained.

In order to provide a double acting device it is proposed to incorporate an outer stator structure in the device of the kind specified, the outer stator structure being located about the armature and having a plurality of axially spaced annular magnetisable pole pieces and a winding arranged so that when electric current flows through the winding adjacent pole pieces will assume opposite magnetic polarity. The diameters of the apertures in the pole pieces increase towards the one end of the inner stator structure.

With such an arrangement a problem exists in that when the armature is in one extreme position, i.e. portions of the armature are in engagement with the pole pieces of one of the stator structures then when the winding of the other stator structure is energised to move the armature towards the other extreme position, parts of the one stator structure provide magnetic shunts for the magnetic flux passing through the armature. These magnetic shunts include the air gaps which are in effect closed because the armature is in the one extreme position. Thus the magnetic flux in the aforesaid shunts in conjunction with the air gaps, can hold the armature in the one extreme position in spite of the fact that the winding of the other stator structure is energised and the flux generated thereby is passing across the main air gaps which are of course at their maximum size.

The object of the present invention is to provide a device of the kind specified in a simple and convenient form in which the problem outlined above is overcome.

According to the invention a device of the kind specified comprises an outer stator structure which surrounds the armature, the armature having a generally tapering outer surface, said outer stator structure having a plurality of axially spaced annular magnetisable pole pieces and winding arranged so that when electric current flows through the winding adjacent pole pieces will assume opposite magnetic polarity, the outer stator structure being axially displaced relative to the inner stator structure whereby the magnetic circuits in the armature for the flux produced by the inner and outer stator structures when the respective windings are energised are displaced relative to each other.

A device in accordance with the invention will now be described with reference to the accompanying drawings in which.

Figure 1:
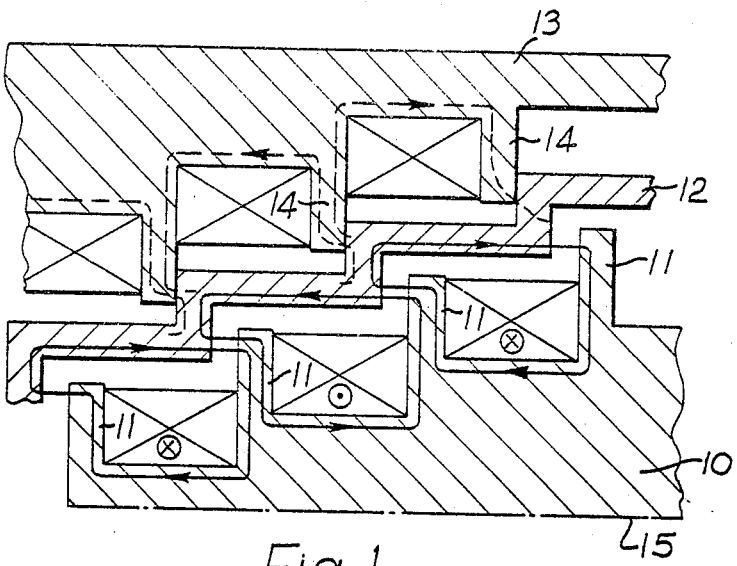
FIG. 1 shows a construction of the device which exhibits the problem outlined above.

Referring to FIG. 1 of the drawings the device comprises an inner stator structure 10 which is formed from magnetisable material and which has a plurality of radially extending pole pieces indicated at 11 on its peripheral surface. The extremities of the pole pieces have a diameter which reduces towards one end of the stator structure and located between the pairs of adjacent pole pieces are groove which accommodate windings. The windings are not illustrated in FIG. 1 but nevertheless, the direction of current flow in the windings is indicated by the dot and cross configuration and it will be noted that the current flow in adjacent windings is in the opposite direction.

Also provided is an armature 12 which is of annular form having a generally tapering inner surface. In fact the inner surface comprises a series of steps the side faces of which are presented to the pole pieces 11.

The external peripheral surface of the armature is also of generally tapering form and has complementary steps to the steps formed on the internal surface thereof.

An outer stator structure is provided and this comprises an annular member 13 formed from magnetisable material. On its internal surface the annular member carries pole pieces 14 and the diameters of the inner extremities of the pole pieces when considered in relation to the centre line 15 of the device, increase as the diameters of the pole pieces 11 increase. The pole pieces 11 and 14 are not in axial alignment, they are displaced by the travel of the armature plus the thickness of the material forming the armature.

The grooves defined between the windings 14 are occupied by windings and these windings can be supplied with electric current to cause the pole pieces to assume opposite magnetic polarity.

In FIG. 1 the armature 12 is shown to be in one extreme position it being assumed that this position has been attained by energising the windings carried by the outer stator structure. It is now required to move the armature to the other extreme position. In order to do this the windings on the stator structure 10 are energised and those on the structure 13 de-energised. The pole pieces 11 become magnetised, adjacent pole pieces having opposite magnetic polarity. The main magnetic flux paths are shown by the solid lines with arrows and it will be seen that the flux traverses the gaps between the pole pieces and the steps on the armature. The effect of this is to impart to the armature a force tending to move it towards the right as shown in FIG. 1. Unfortunately however magnetic shunts are formed by the outer stator structure and the magnetic flux flowing in these shunts is indicated by the dotted lines. The magnetic circuits of the shunts include the closed air gaps between the steps on the armature and the pole pieces 14 and it is found with this arrangement that the armature tends to remain in the one extreme position. In order to minimise this problem, the construction shown in FIG. 2 is adopted.

Figure 2:
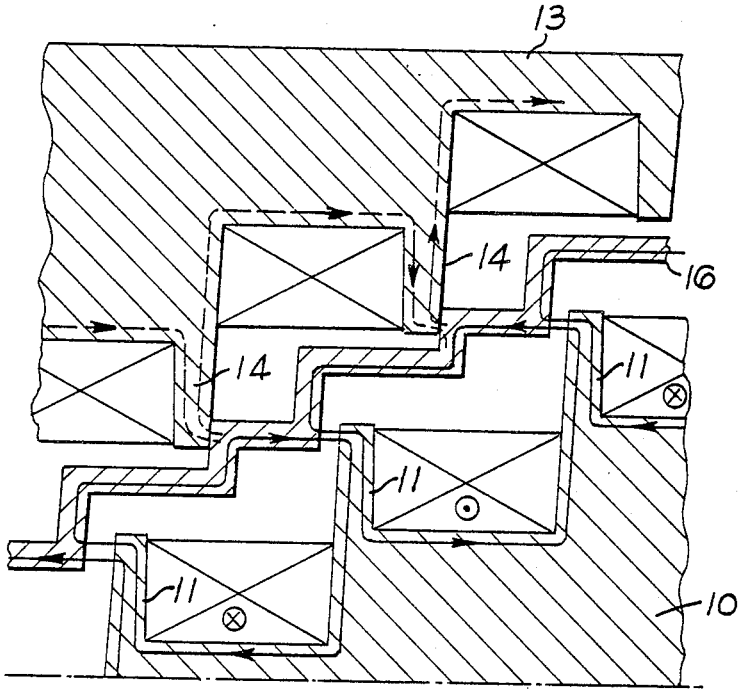
FIG. 2 shows a modification necessary to minimise the risk of the armature sticking in one extreme position.

Turning now to FIG. 2 identical reference numerals are used wherever possible, and in this construction it will be noted that the armature is of a different form. The armature is referenced 16 and it will be seen to have double the number of steps as compared with the armature shown in FIG. 1. The practical effect of this is that the primary magnetic circuit through the armature of the flux flowing between adjacent pole pieces 11 is displaced relative to the primary magnetic circuit in the armature of the flux flowing between a pair of pole pieces 14 when the latter are energised, of the outer stator structure. The overlap is substantially half. The flux paths are shown in FIG. 2 in exactly the same configuration as FIG. 1 but the flux flow in the pole pieces 14 constituted by the stator 13 are for illustration only since it will be noted that the flux flow in each pole piece is in effect substantially zero. As a result of this there is substantially no restraint on the movement of the armature from the one to the other extreme position. This is true for the intermediate pole pieces but is not true for the end pole pieces since there is no balancing flux from an adjacent winding on the other stator structure. The result is therefore that an attraction force may be developed at the end pole pieces but this is very small due to the long magnetic path involved, this magnetic path extending along the whole length of the stator structures.

Figure 3:
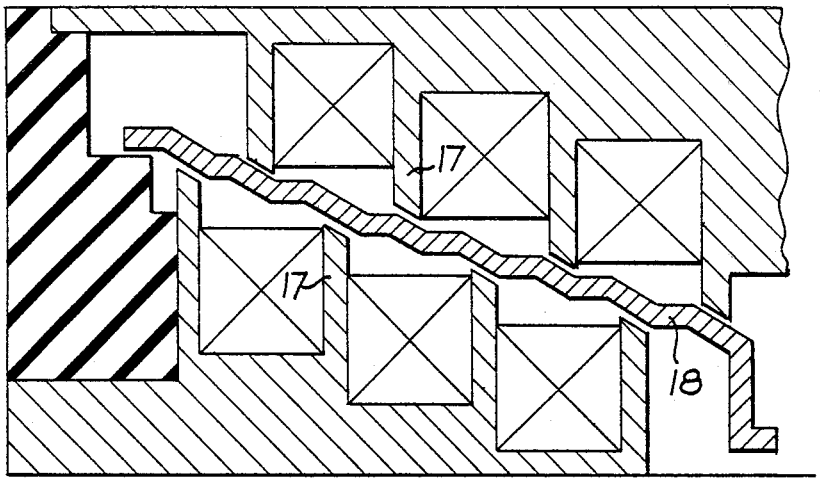
FIGS. 3 and 4 show alternative forms of construction of the armature and stator structures.
Figure 4:
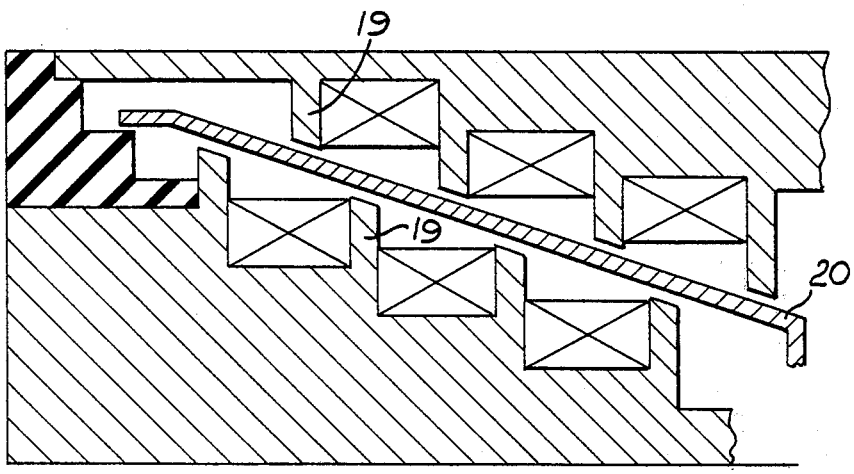

The armatures 12 and 16 are of generally tapered configuration although the air gaps are defined between radially extending surfaces. In the arrangement shown in FIG. 3, the ends of the pole pieces 17 on the stator structures are inclined and the co-operating portions of the armature 18 are also inclined. As in the example of FIG. 2, the primary magnetic circuits through the armature due to the two stator structures, overlap and the flux paths will be as indicated in FIg. 2. In FIG. 4 the faces of the pole pieces 19 of the two stator structure are also inclined and correspond to the inclination of the inner and outer surfaces of the armature 20 which in this case are smooth.

In order to achieve rapid movement of the armature the windings of one stator structure may be energised before the windings of the other stator structure are deenergised. The flux produced by the other stator structure will hold the armature until the windings thereof are deenergised. Full energisation of the windings can be allowed to take place with the current being allowed to reach the maximum value. The current switching device may be arranged so that the current in the one winding does not achieve its maximum value before the other winding is de-energised.

In order to conserve power it is possible once the armature has moved to one of its extreme positions, to supply pulses of current to maintain the armature in that position. The time at which the other winding is energised in this case must not be too early before the one winding is de-energised otherwise the armature may move to its other extreme position before the one winding is de-energised.

We claim:

1. An electromagnetic device comprising an elongated inner stator structure which defines a plurality of axially spaced annular magnetisable pole pieces, said pole pieces having diameters which increases toward one end of the stator structure, a winding carried by the stator structure and which when supplied with electric current causes adjacent pole pieces to assume opposite magnetic polarity, an annular armature surrounding the stator structure said armature being formed from magnetisable material and having a generally tapered inner surface whereby when current is supplied to the winding the armature will move axially towards the one end of the stator structure, an outer stator structure which surrounds the armature, the armature having a generally tapering outer surface, said outer stator structure having a plurality of axially spaced annular magnetisable pole pieces and a winding arranged so that when electric current flows through the winding adjacent pole pieces will assume opposite magnetic polarity, the outer stator structure being axially displaced relative to the inner stator structure whereby the magnetic circuits in the armature for the flux produced by the inner and outer stator structures when the respective windings are energised are displaced relative to each other.

2. An electromagnetic device according to claim 1 in which the external and internal surfaces of the armature are of stepped form to define faces presented to the pole piece of the inner and outer stator structures respectively the faces on the inner surface of the armature which are presented and are attached to the pole pieces of the inner stator structure being axially displaced relative to the faces on the outer surface of the armature which are presented and are attracted to the pole pieces of the outer stator structure.

3. An electromagnetic device according to claim 2 in which the pole faces of the pole pieces and said faces on the armature are radial.

4. An electromagnetic device according to claim 2 in which the pole faces of the pole pieces and said faces on the armature are inclined to the longitudinal axis of the device.

5. An electromagnetic device according to claim 1 in which the inner and outer surfaces of the armature are smooth and the faces of the pole pieces of the stator structures which are presented the surfaces of the armature are inclined, the pole faces of the stator structures being axially displaced relative to each other.

* * * * *